US012146338B1

(12) United States Patent
Li

(10) Patent No.: US 12,146,338 B1
(45) Date of Patent: Nov. 19, 2024

(54) DEFORMABLE FOLDING FENCE

(71) Applicant: Zhixin Li, Hebei (CN)

(72) Inventor: Zhixin Li, Hebei (CN)

( * ) Notice: Subject to any disclaimer, the term of this patent is extended or adjusted under 35 U.S.C. 154(b) by 0 days.

(21) Appl. No.: 18/533,779

(22) Filed: Dec. 8, 2023

(30) Foreign Application Priority Data

Nov. 22, 2023 (CN) ..... 202323154940.X

(51) Int. Cl.
*E04H 17/14* (2006.01)
*E04H 17/00* (2006.01)
*E04H 17/18* (2006.01)

(52) U.S. Cl.
CPC ..... *E04H 17/18* (2013.01); *E04H 17/009* (2021.01); *E04H 17/1448* (2021.01); *E04H 17/1473* (2021.01)

(58) Field of Classification Search
CPC ..... E04H 17/009; E04H 17/1413; E04H 17/1448; E04H 17/1473; E04H 17/1488; F16B 7/042; Y10T 403/32483
See application file for complete search history.

(56) References Cited

U.S. PATENT DOCUMENTS 5,779,386 A * 7/1998 Eichhorn ..... F16B 7/0413 403/328
9,500,000 B2 11/2016 Mccarty
9,644,393 B2 * 5/2017 McCue ..... E04H 17/1413
11,066,870 B1 * 7/2021 Flannery ..... A01K 1/035
11,440,609 B2 * 9/2022 Jewell ..... B62K 21/02
11,459,781 B2 * 10/2022 Huang ..... F16B 7/042
2007/0210293 A1 * 9/2007 Cheng ..... E04H 17/18 256/26
2012/0100940 A1 * 4/2012 Hajarian ..... A63B 63/004 473/476
2023/0061630 A1 3/2023 Luczycki et al.
2023/0127173 A1 4/2023 Awad
2023/0144870 A1 5/2023 Naylor et al.

FOREIGN PATENT DOCUMENTS

WO WO 2021/028498 * 2/2021 ..... B08B 9/0436

* cited by examiner

*Primary Examiner* — Michael P Ferguson

(57) ABSTRACT

The present utility model relates to a deformable folding fence, including multiple groups of quick fixing assemblies, in which the multiple groups of quick fixing assemblies are connected to upper rods, lower rods and support rods, and two ends of each of the upper rods, the lower rods and the support rods are both provided with an elastic button and a clamping groove, each quick fixing assembly includes a fixing member main body, and a side wall of the fixing member main body is connected to a middle sleeve, so as to utilize the quick fixing assemblies, the upper rods, the lower rods, the support rods and the interaction among various components, so that the fences of different shapes can be spliced according to usage requirements and fields.

7 Claims, 6 Drawing Sheets

DEFORMABLE FOLDING FENCE

CROSS REFERENCE

This application claims priority benefits to Chinese Patent Application No. 202323154940.X, filed Nov. 22, 2023, the contents of which are incorporated herein by reference.

TECHNICAL FIELD

The present utility model relates to the technical field of fences, specifically relating to a deformable folding fence.

BACKGROUND

At present, the fences on the market are not deformable, and during use, the adjustment operation of the fences cannot be performed according to sites in use. In view of the described problem, it is necessary to provide a deformable folding fence.

CONTENT

The object of the present utility model is to provide a deformable folding fence to solve the problem mentioned in the described background art.

To achieve the object above, the present utility model provides the following technical solutions:

a deformable folding fence, including multiple groups of quick fixing assemblies, in which the multiple groups of quick fixing assemblies are connected to upper rods, lower rods and support rods, and two ends of each of the upper rods, the lower rods and the support rods are both provided with an elastic button and a clamping groove;

each quick fixing assembly includes a fixing member main body, a side wall of the fixing member main body is connected to a middle sleeve, a locking member is provided on the side wall of the fixing member main body and on a side of the middle sleeve, and a connecting rod sleeve is connected to side walls of the fixing member main body and the middle sleeve, a side wall of the connecting rod sleeve is provided with a key switch corresponding to the elastic button, the side wall of the fixing member main body is provided with a fixing groove corresponding to the elastic button, a side wall of the fixing member main body in contact with the middle sleeve is provided with a fastening insection, and the bottom of the fixing member main body is connected to a fixing suction cup.

As a preferable solution of the present utility model, each connecting rod sleeve is provided with a connecting hole corresponding to the upper rod and the lower rod, in which the upper rod, the lower rod and the connecting hole are in a clearance fit.

As a preferable solution of the present utility model, the fixing member main body is provided with a connecting hole corresponding to the support rod, and the support rod and the connecting hole are in a clearance fit.

As a preferable solution of the present utility model, the side wall of the fixing member main body is rotatably connected to a middle ring of the middle sleeve.

As a preferable solution of the present utility model, threads, corresponding to the locking piece, are provided on the side wall of the fixing member main body, and a connection manner the locking member and the threads is a threaded connection.

As a preferable solution of the present utility model, the side wall of the fixing member main body is provided with a fastening clastic piece corresponding to the support rod.

As a preferable solution of the present utility model, an inner cavity of the connecting rod sleeve is provided with a limiting rod corresponding to the clamping groove, and the clamping groove and the limiting rod are in a clearance fit.

Compared with the prior art, the beneficial effects of the present utility model lie in that: 1, in the present utility model, by providing quick fixing assemblies, an upper rod, a lower rod and a support rod in the deformable folding fence, so as to utilize the quick fixing assemblies, the upper rod, the lower rod, the support rod and the interaction among various components, so that the fence can be designed to be connected in a polygonal shape and can be folded, the fences of different shapes can be spliced and folded according to usage requirements and fields during use of the deformable folding fences, and thus the device is more convenient to use, solving the problem that fences of different shapes cannot be spliced according to use requirements and fields, and the problem of working in a folding manner.

Figure 1:
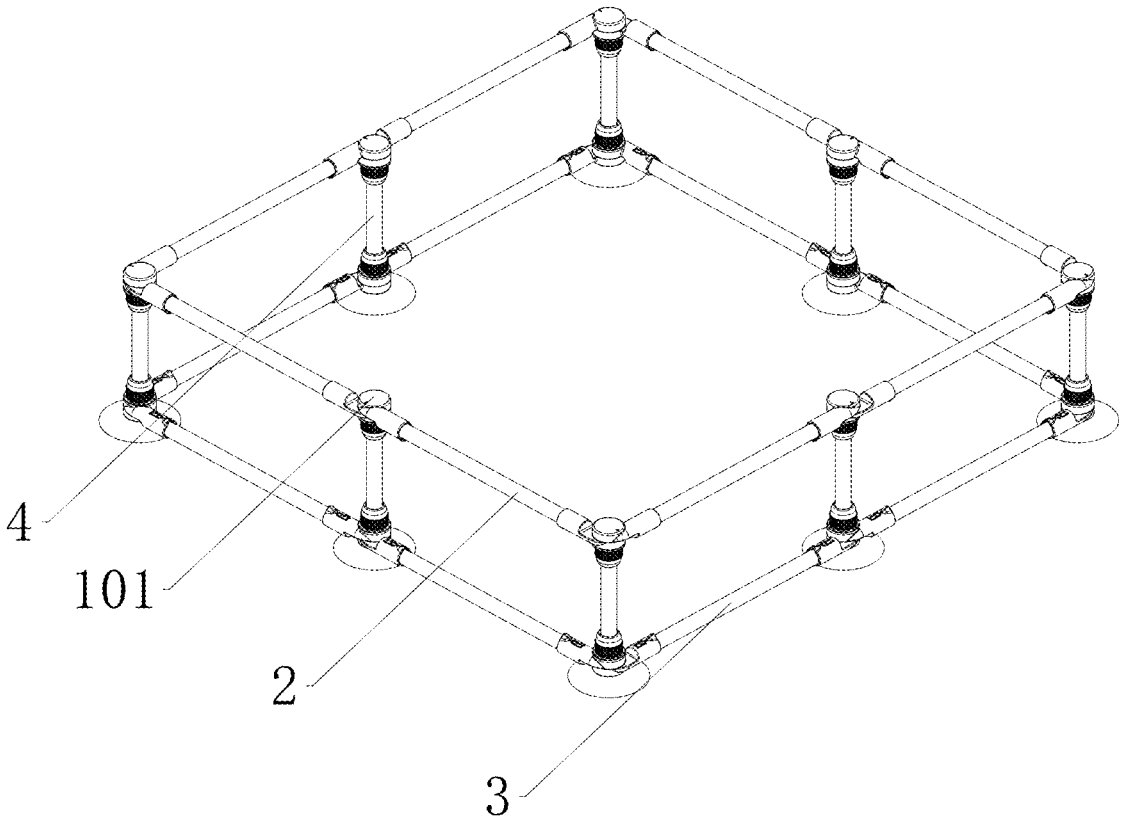
FIG. 1 is an isometric structural schematic diagram of a rectangular fence in the present utility model.

In the drawings: 1, quick fixing assembly; 2, upper rod; 3, lower rod; 4, support rod; 5, clastic button; 6, clamping groove; 101, fixing member main body; 102, a middle sleeve; 103, a locking member; 104, a connecting rod sleeve; 105, a key switch; 106, a fixing groove; 107, a fastening insection; 108, a fixing suction cup.

DETAILED DESCRIPTION

The technical solutions in the embodiments of the present utility model will be clearly and completely described as follows with reference to the embodiments of the present utility model; apparently, the described embodiments are merely a part rather than all of the embodiments of the present utility model. Based on the embodiments of the present utility model, those skilled in the art can obtain other embodiments without inventive effort, which all belong to the scope of protection of the present utility model.

In order to facilitate understanding of the present utility model, the present utility model will be described more fully hereinafter with reference to the accompanying drawings, and several embodiments of the present utility model are provided. However, the present utility model can be implemented in many different forms and is not limited to the embodiments described herein. On the contrary, the purpose of these embodiments is to make the disclosure of the present utility model more thorough.

It should be noted that, when an element is referred to as being "fixed to" another element, the element may be directly on the other element or may also have a central element; when an element is considered to be "connected to"

another element, the element may be directly connected to the other element or may have a central element at the same time. The terms "vertical", "horizontal", "left", "right" and similar expressions used herein are only used for illustrative purposes.

Unless otherwise defined, all technical and scientific terms used herein have the same meaning as commonly understood by those of ordinary skill in the art to which this utility model belongs. The terms used herein in the description of the present utility model are for the purpose of describing particular embodiments only, and are not intended to limit the present utility model. As used herein, the term "and/or" includes any and all combinations of one or more of the associated listed items.

Figure 2:
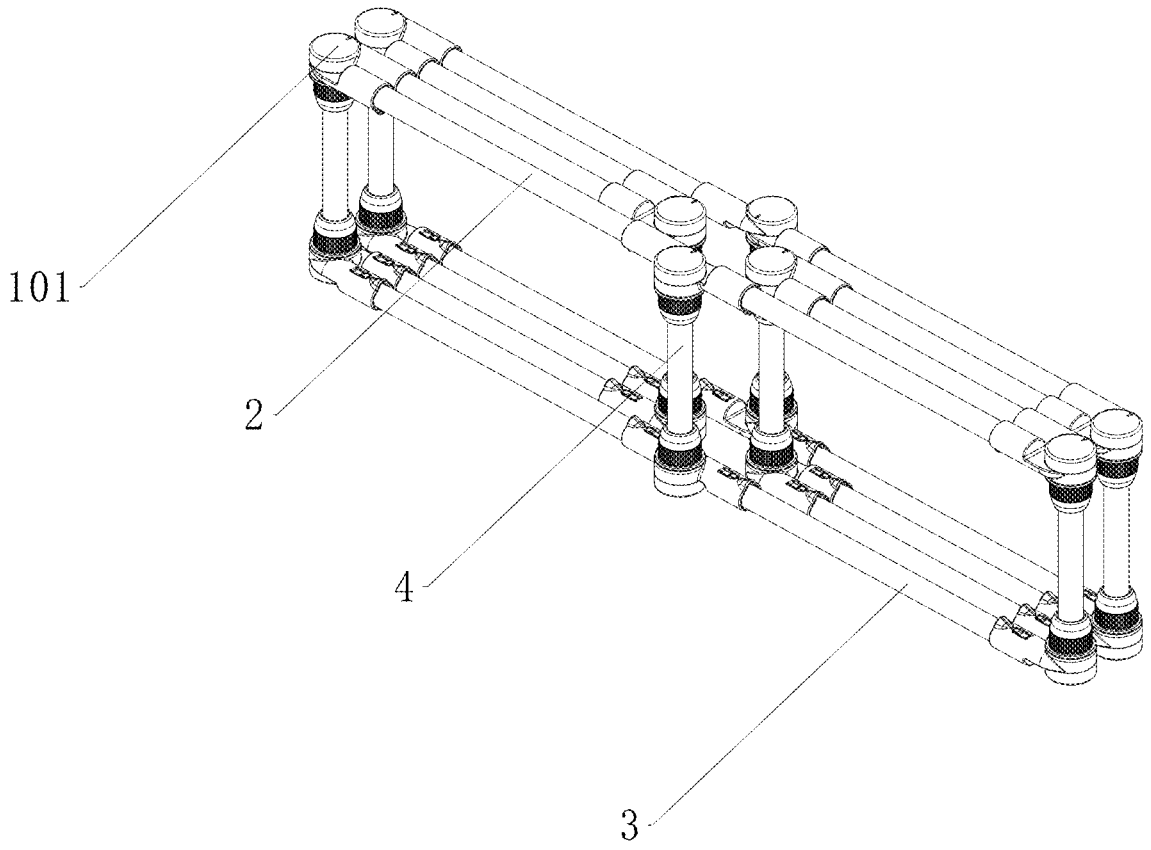
FIG. 2 is a schematic diagram of a folding structure of FIG. 2 of the present utility model.
Figure 3:
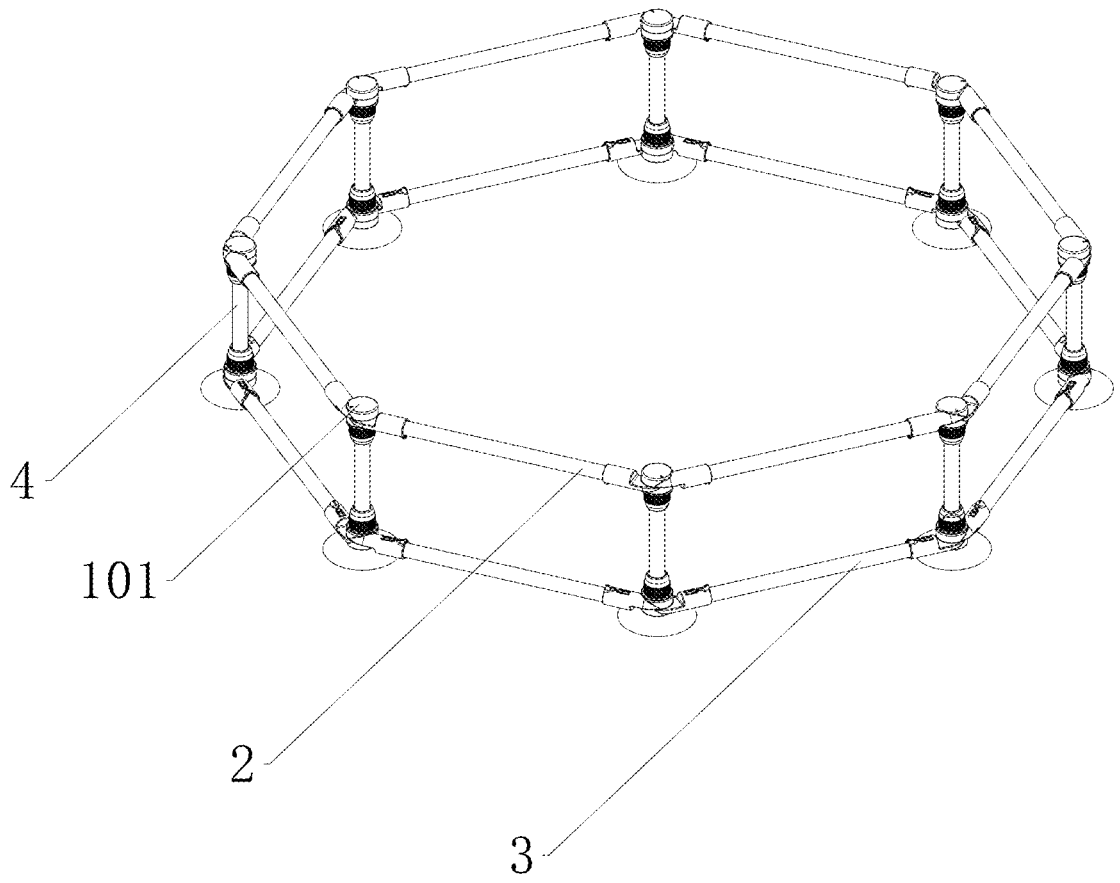
FIG. 3 is an isometric schematic diagram of a polygonal fence in the present utility model.
Figure 4:
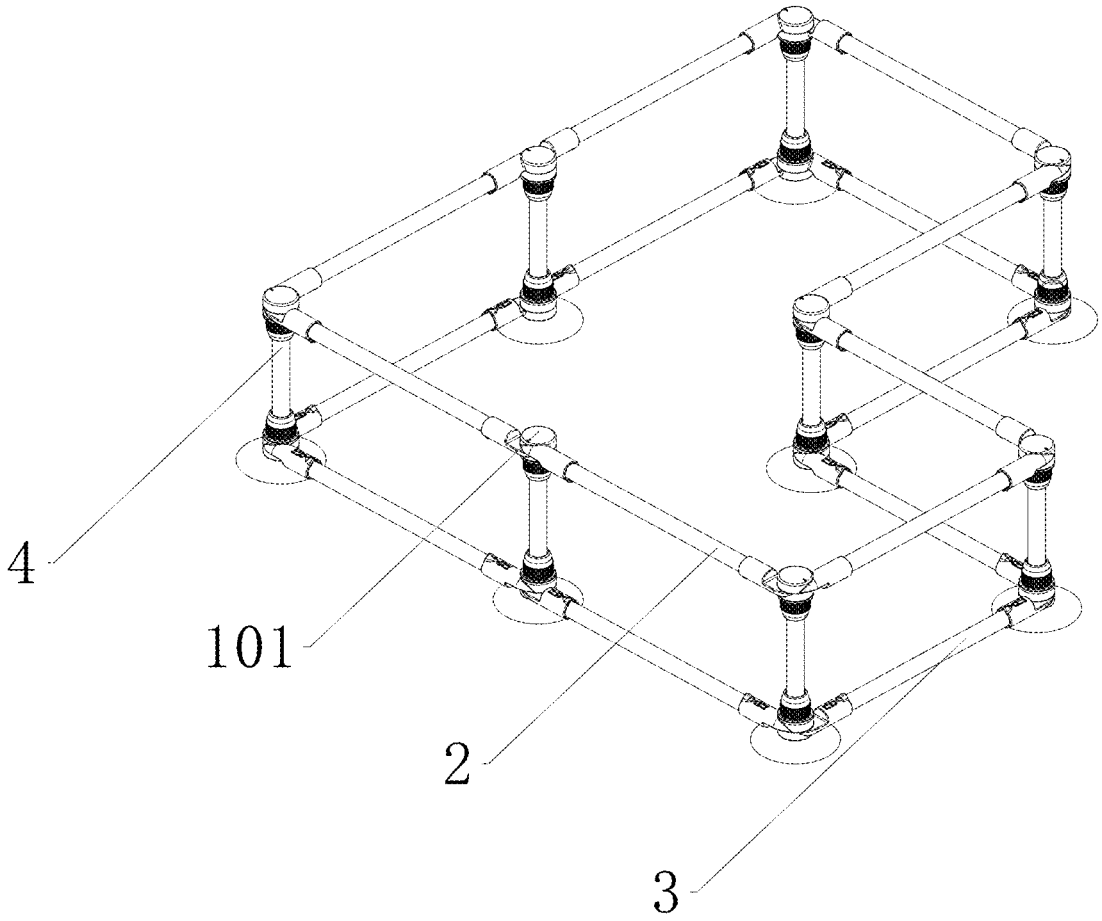
FIG. 4 is an isometric structural diagram of a deformable fence of the present utility model.
Figure 5:
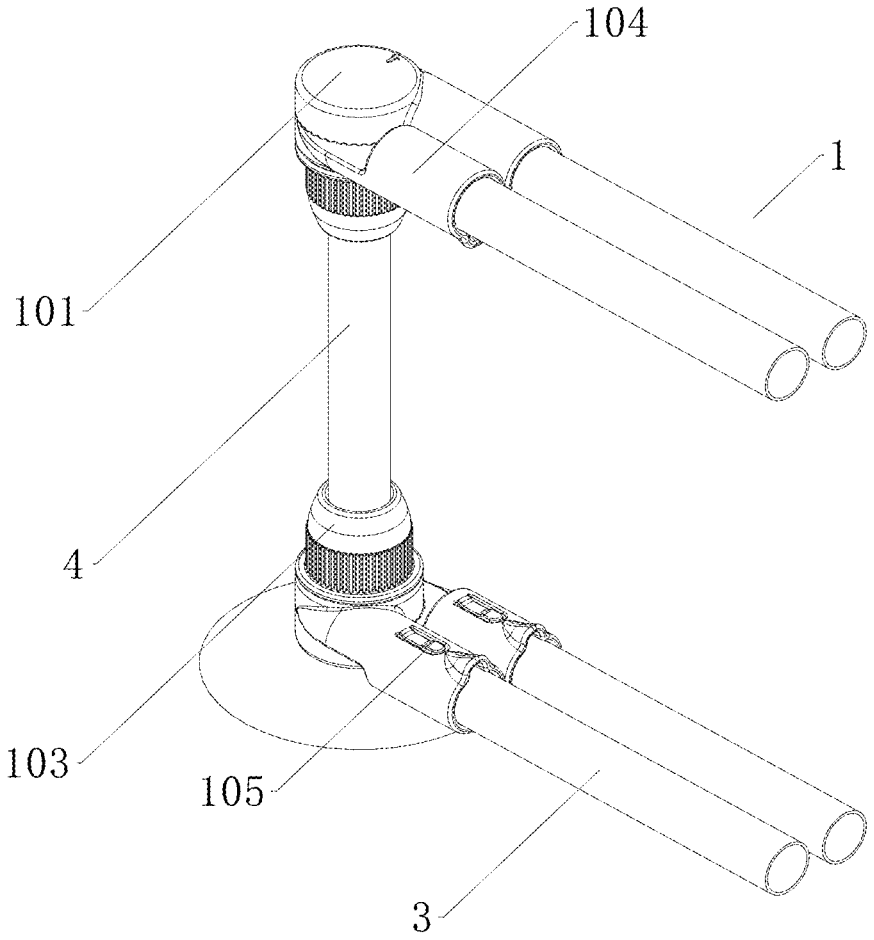
FIG. 5 is a structural schematic diagram of a quick fixing assembly of the present utility model.
Figure 6:
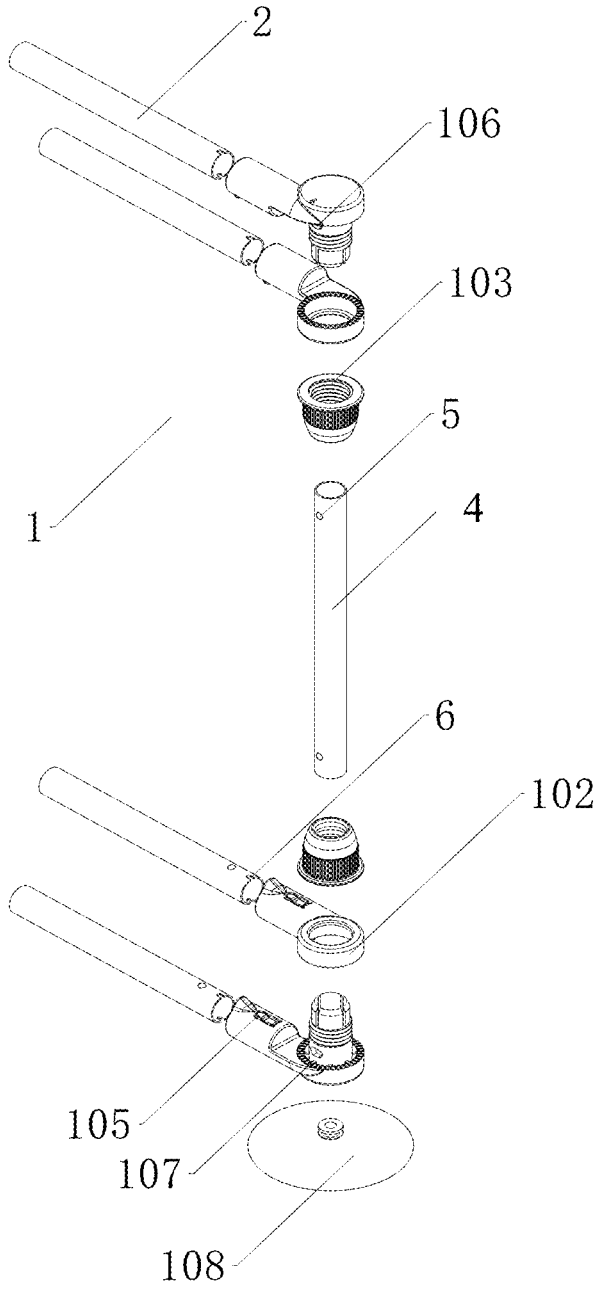
FIG. 6 is an exploded structural schematic diagram of FIG. 5 of the present utility model.

Embodiments, with reference to FIGS. 1-6, the present utility model provides a technical solution:

A deformable folding fence, including multiple groups of quick fixing assemblies 1, in which the multiple groups of quick fixing assemblies 1 are connected to upper rods 2, lower rods 3 and support rods 4, and two ends of each of the upper rods 2, the lower rods 3 and the support rods 4 are both provided with an elastic button 5 and a clamping groove 6;

in this embodiment, referring to FIGS. 1, 2 and 6, each quick fixing assembly 1 includes a fixing member main body 101, a side wall of the fixing member main body 101 is connected to a middle sleeve 102, a locking member 103 is provided on the side wall of the fixing member main body 101 and on a side of the middle sleeve 102, and a connecting rod sleeve 104 is connected to side walls of the fixing member main body 101 and the middle sleeve 102; a side wall of the connecting rod sleeve 104 is provided with a key switch 105 corresponding to the clastic button 5, the side wall of the fixing member main body 101 is provided with a fixing groove 106 corresponding to the elastic button 5, a side wall of the fixing member main body 101 in contact with the middle sleeve 102 is provided with a fastening insection 107, and the bottom of the fixing member main body 101 is connected to a fixing suction cup 108, and the connecting rod sleeve 104 is provided with connecting holes corresponding to the upper rod 2 and the lower rod 3; the upper rod 2, the lower rod 3 and the connecting holes are in a clearance fit such that the connecting rod sleeve 104 and the upper rod 2 and the lower rod 3 are fitted with each other, thus mounting of the connecting rod sleeve 104 between the upper rod 2 and the lower rod 3 is completed, and the fixing member main body 101 is provided with a connecting hole corresponding to the support rod 4, in which the mounting between the fixing member main body 101 and the support rod 4 is completed under the condition that the support rod 4 and the connecting hole are in a clearance fit; under the condition that the connection manner between the side wall of the fixing member main body 101 and the middle ring of the middle sleeve 102 is a rotational connection, the angle between the upper rod 2 and the lower rod 3 is adjusted, a fixing groove 106, corresponding to the clastic buttons 5, is provided on the side wall of the fixing member main body 101, and a fastening insection 107 is provided on the side wall of the fixing member main body 101 in contact with the middle sleeve 102; the side wall of the fixing member main body 101 is provided with threads corresponding to the locking member 103, in which under the condition that the connection manner between the locking member 103 and the threads is a threaded connection, the fixing operation of the support rod 4 is completed, and then the splicing operation of the fence is completed;

the connecting rod sleeve 104 is provided with connecting holes corresponding to the upper rod 2 and the lower rod 3, the upper rod 2, the lower rod 3 and the connecting holes are in a clearance fit, the fixing member main body 101 is provided with a connecting hole corresponding to the support rod 4, the support rod 4 and the connecting hole are fitted in a clearance fit, and the side wall of the fixing member main body 101 is rotatably connected to the middle ring of the middle sleeve 102; the side wall of the fixing member main body 101 is provided with threads corresponding to the locking member 103, in which the connection manner between the locking member 103 and the threads is a threaded connection, a fastening clastic piece corresponding to the support rod 4 is provided on the side wall of the fixing member main body 101, and a limiting rod corresponding to the clamping groove 6 is provided in an inner cavity of the connecting rod sleeve 104, and the fitting manner between the clamping groove 6 and the limiting rod is a clearance fit design, so that the device is more convenient to use.

The working process of the present utility model is as follows: when a deformable folding fence is used, first, according to the shape used for the fence, selecting a corresponding number of quick fixing assemblies 1, upper rods 2, lower rods 3 and support rods 4, and then providing connecting holes corresponding to the upper rods 2 and the lower rods 3 on connecting rod sleeves 104, in which under the condition that the upper rods 2, the lower rods 3 and the connecting holes are in a clearance fit, the connecting rod sleeves 104 and the upper rods 2 and the lower rods 3 are fitted with each other, thereby completing the mounting of the connecting rod sleeves 104 and the upper rods 2 and the lower rods 3; each connecting hole is provided on a fixing member main body 101 and corresponding to a support rod 4, in which the mounting between the fixing member main body 101 and the support rod 4 is completed under the condition that the support rod 4 and the connecting hole are in a clearance fit, and the angle between an upper rod 2 and a lower rod 3 is adjusted under the condition that the connection manner between the side wall of the fixing member main body 101 and the middle ring of the middle sleeve 102 is rotational connection, the side wall of each fixing member main body 101 is provided with a fixing groove 106 corresponding to the elastic button 5, the side wall of the fixing member main body 101 in contact with the middle sleeve 102 is provided with a fastening insection 107, and the side wall of each fixing member main body 101 is provided with threads corresponding to the locking member 103, in which under the condition that the connection manner between the locking member 103 and the threads is a threaded connection, the fixing operation of the support rod 4 is completed, and then the splicing operation of the fence is completed.

Although the embodiments of the present utility model are shown and described, it would be appreciated by those skilled in the art that changes, modifications, alternatives and modifications can be made to these embodiments without departing from the principle and spirit of the present utility model, and the scope of the present utility model is defined by the appended claims and their equivalents.

What is claimed is:

1. A deformable folding fence, comprising:

a plurality of fence rail upper rods;

a plurality of fence rail lower rods; and a plurality of fence post support rods; and a plurality of quick fixing assemblies disposed at opposing ends of the support rods for connecting the upper and lower rods thereto;

wherein opposing ends of each of the upper rods, the lower rods and the support rods are both provided with an elastic button and a clamping groove;

wherein each quick fixing assembly comprises a fixing member main body, a middle sleeve, and a locking member;

wherein each fixing member main body comprises a longitudinally-extending hollow shaft, an annular head radially-extending from a distal end of the longitudinally-extending hollow shaft, and a shoulder of the annular head defined therebetween, the longitudinally-extending hollow shaft defining a cylindrical first side wall of the fixing member main body, the annular head defining a cylindrical second side wall of the fixing member main body, and the shoulder defining a radially-extending third side wall of the fixing member main body, the first side wall and the second side wall being coaxial and extending along a longitudinal axis of the fixing member main body, a circumference of the second side wall being greater than that of the first side wall, and the third side wall extending along a width axis of the fixing member main body and connecting the first side wall and the second side wall;

wherein the first side wall of each fixing member main body is inserted into a corresponding middle sleeve, a corresponding locking member is sleeved outside the first side wall of the fixing member main body, and the middle sleeve is located between the third side wall of the fixing member main body and the locking member;

wherein a connecting rod sleeve is connected to the second side wall of each fixing member main body and another connecting rod sleeve is connected to an outside wall of each middle sleeve, and a side wall of each connecting rod sleeve is provided with a key switch corresponding to the elastic buttons of the upper and lower rods;

wherein the first side wall of each fixing member main body is provided with a fixing groove corresponding to the elastic buttons of the support rods, the fixing groove is covered by the middle sleeve, the third side wall of the fixing member main body is provided with a fastening insection interlockably contacting with the middle sleeve for preventing rotation therebetween, and a bottom of each fixing member main body connected to the lower rods is connected to a fixing suction cup; and wherein the upper rods and the lower rods are received within the connecting rod sleeves of the fixing member main bodies and middle sleeves through the clamping grooves, and the support rods are received within the longitudinally-extending hollow shafts of the fixing member main bodies through the elastic buttons.

2. The deformable folding fence according to claim 1, wherein each connecting rod sleeve is provided with a connecting hole corresponding to the upper rod and the lower rod, and the upper rod, the lower rod and the connecting hole are in a clearance fit.

3. The deformable folding fence according to claim 1, wherein each fixing member main body is provided with a connecting hole corresponding to the support rod, and the support rod and the connecting hole are in a clearance fit.

4. The deformable folding fence according to claim 1, wherein the connection manner between the first side wall of the fixing member main body and a middle ring of the middle sleeve is a rotating connection.

5. The deformable folding fence according to claim 1, wherein the first side wall of each fixing member main body is provided with threads corresponding to the locking member, and the connection manner between the locking member and the threads is a threaded connection.

6. The deformable folding fence according to claim 1, wherein the side wall of the fixing member main body is provided with a fastening elastic piece corresponding to the support rod.

7. The deformable folding fence according to claim 1, wherein an inner cavity of each connecting rod sleeve is provided with a limiting rod corresponding to the clamping groove, and the clamping groove and the limiting rod are in a clearance fit.

* * * * *